US008369757B2

(12) United States Patent
Kojima

(10) Patent No.: US 8,369,757 B2
(45) Date of Patent: Feb. 5, 2013

(54) IMAGE FORMING APPARATUS

(75) Inventor: Etsuji Kojima, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 350 days.

(21) Appl. No.: 12/175,911

(22) Filed: Jul. 18, 2008

(65) Prior Publication Data

US 2009/0028594 A1 Jan. 29, 2009

(30) Foreign Application Priority Data

Jul. 24, 2007 (JP) ..... 2007-191503

(51) Int. Cl.
*G03G 15/00* (2006.01)

(52) U.S. Cl. ..... 399/302; 399/309

(58) Field of Classification Search ..... 399/297–302, 399/308, 309, 66, 68, 69
See application file for complete search history.

(56) References Cited

U.S. PATENT DOCUMENTS

| | | | | |
|---|---|---|---|---|
| 7,313,352 | B2 * | 12/2007 | Shinohara et al. | 399/301 |
| 2002/0031361 | A1 * | 3/2002 | Shiiya | 399/68 |
| 2005/0074251 | A1 * | 4/2005 | Katoh et al. | 399/68 |
| 2006/0056864 | A1 * | 3/2006 | Zaima | 399/27 |
| 2006/0127112 | A1 * | 6/2006 | Ono | 399/38 |
| 2007/0059007 | A1 * | 3/2007 | Ai | 399/49 |
| 2007/0217807 | A1 * | 9/2007 | Maeda et al. | 399/69 |
| 2007/0230983 | A1 * | 10/2007 | Nakamoto et al. | 399/69 |

FOREIGN PATENT DOCUMENTS

| | | | |
|---|---|---|---|
| JP | 9-90779 | A | 4/1997 |
| JP | 10-197933 | A | 7/1998 |
| JP | 2001-337573 | A | 12/2001 |
| JP | 2006-243377 | A | 9/2006 |

OTHER PUBLICATIONS

Notification of Reason for Rejection mailed May 29, 2012, in Japanese Application No. 2007-191503.

* cited by examiner

*Primary Examiner* — Walter L Lindsay, Jr.
*Assistant Examiner* — Jessica L Eley
(74) *Attorney, Agent, or Firm* — Fitzpatrick, Cella, Harper & Scinto

(57) ABSTRACT

An image forming apparatus includes a plurality of image bearing members; a rotatable intermediary transfer member for carrying toner images transferred from the plurality of image bearing members in contact with the plurality of image bearing members; a transfer member for press-contacting to the intermediary transfer member to form a transfer portion, at which the toner images on the intermediary transfer member are to be transferred onto a recording material; and a control portion for controlling an image forming operation so that, during execution of a continuous image forming mode in which images are formed on a plurality of recording materials conveyed with a preset minimum interval, a recording material passes through the transfer portion and thereafter transfer of a toner image to be formed on a subsequent recording material from an image bearing member, located upstream of the transfer portion and most downstream of the plurality of image bearing members with respect to a rotational direction of the intermediary transfer member, onto the intermediary transfer member is started.

9 Claims, 7 Drawing Sheets

IMAGE FORMING APPARATUS

FIELD OF THE INVENTION AND RELATED ART

The present invention relates to an image forming apparatus, including an intermediary transfer member, such as a printer, a copying machine, a facsimile machine, or a multifunction machine.

As a color image forming apparatus, an image forming apparatus provided with an intermediary transfer member, such as an intermediary transfer belt or an intermediary transfer drum, for conveying a toner image carried at a primary transfer portion to a secondary transfer portion has been put into practical use.

The image forming apparatus provided with the intermediary transfer member is downsized by shortening a distance from the primary transfer portion to the secondary transfer portion. Further, the image forming apparatus provided with the intermediary transfer member is capable of effecting image formation at high speed in the high productivity by continuously conveying a recording material to the secondary transfer portion. However, generally, a conveying speed of the recording material and the productivity of the image formation are determined depending on throughput of a fixing device for fixing the toner image on the recording material by application of heat and pressure.

For example, as described in Japanese Laid-Open Patent Application (JP-A) 2006-243377, an interval of toner image formation on an image bearing member is set depending on a temperature detection result of a fixing device to improve productivity by the fixing device. Further, JP-A Hei 10-197933 discloses an image forming apparatus in which the interval of toner image formation on the image bearing member is set depending on a target glossiness of a fixed image.

In such an image forming apparatus, so long as the throughput of the fixing device has a margin, the image formation interval, i.e., a sheet interval can be decreased as short as possible.

However, in the case the short sheet interval, the following problem arises. That is, when an image is transferred from an intermediary transfer member onto a recording material at a secondary transfer portion, there is the case where a toner image is transferred (primary-transferred) onto the intermediary transfer member from an image bearing member which is located upstream from the secondary transfer portion and nearest to the secondary transfer portion with respect to a rotational direction of the intermediary transfer member. In this case, a shock occurs when a trailing end of the recording material passes through the secondary transfer portion. When that shock is transmitted, through the intermediary transfer member, to a portion at which the primary transfer is effected, such a problem that the toner image is disturbed arises.

For that reason, it is necessary to alleviate the influence of the shock of the intermediary transfer member, occurring when the recording material passes through the secondary transfer, on the toner image to be transferred onto the intermediary transfer member at the primary transfer portion.

SUMMARY OF THE INVENTION

A principal object of the present invention is to alleviate the influence of the shock of the intermediary transfer member, occurring when the recording material passes through the secondary transfer portion, on the toner image to be transferred onto the intermediary transfer member at the primary transfer portion.

Another object of the present invention is to provide an image forming apparatus capable of alleviating such a shock.

According to an aspect of the present invention, there is provided an image forming apparatus comprising:

a plurality of image bearing members;

a rotatable intermediary transfer member for carrying toner images transferred from the plurality of image bearing members in contact with the plurality of image bearing members;

a transfer member for press-contacting to the intermediary transfer member to form a transfer portion, at which the toner images on the intermediary transfer member are to be transferred onto a recording material; and a control portion for controlling an image forming operation so that, during execution of a continuous image forming mode in which images are formed on a plurality of recording materials conveyed with a preset minimum interval, a recording material passes through the transfer portion and thereafter transfer of a toner image to be formed on a subsequent recording material from an image bearing member, located upstream of the transfer portion and most downstream of the plurality of image bearing members with respect to a rotational direction of the intermediary transfer member, onto the intermediary transfer member is started.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, several embodiments of the present invention will be described in detail with reference to the drawings. An image forming apparatus according to the present invention can be carried out also in other embodiments in which a part or all of constitutions of the following embodiments so long as a lower limit of a variably settable interval of toner image formation is defined.

Therefore, the present invention can be carried out by not only a tandem-type full-color image forming apparatus but also an image forming apparatus including a single image bearing member to which a plurality of developing devices is provided. The present invention can also be carried out by image forming apparatuses including three or less or five or more image bearing members contactable with an intermediary transfer member.

In the following embodiments, only a major part of the image forming apparatus concerned with toner image formation and transfer will be described but the present invention can be carried out in various uses such as printers, various printing machines, copying machines, facsimile machines, and multi-function machines, by adding necessary equipment, accessories, and casing structured.

First Embodiment

Figure 1:
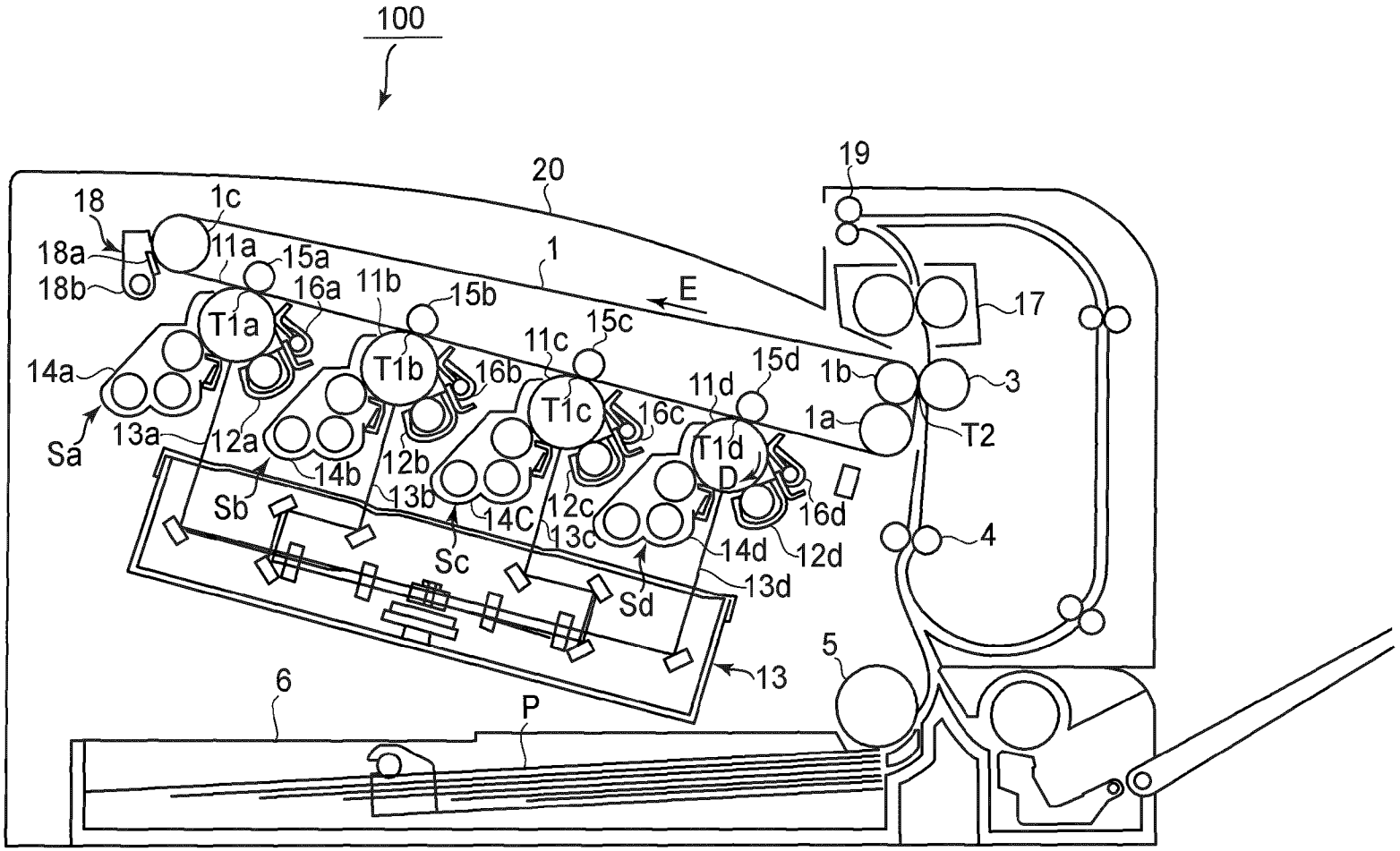
FIG. 1 is a schematic view for illustrating a structure of an image forming apparatus of First Embodiment.

FIG. 1 is an illustration of a structure of an image forming apparatus of First Embodiment.

As shown in FIG. 1, an image forming apparatus 100 of this embodiment is a tandem-type full-color copying machine in which four stations Sa, Sb, Sc and Sd as image forming portions are arranged in a linear section of an intermediary transfer belt 1.

At a first station Sa, a yellow toner image is formed on a photosensitive drum 11*a* as an image bearing member and is primary-transferred, at a primary transfer portion T1*a*, onto the intermediary transfer belt 1 in an image area of the intermediary transfer belt 1. At a second station Sb, a magenta toner image is formed on a photosensitive drum 11*b* as an image bearing member and is primary-transferred, at a primary transfer portion T1*b*, onto the yellow toner image on the intermediary transfer belt 1 in a superposition manner. At third and fourth stations Sc and Sd, a cyan toner image and a black toner image are formed, respectively, and are similarly primary-transferred onto the intermediary transfer belt 1 at primary transfer portions T1*c* and T1*d*, respectively.

The four color toner images successively primary-transferred onto the intermediary transfer belt 1 as an intermediary transfer member are conveyed to a secondary transfer portion T2 at which the toner images are secondary-transferred onto a recording material P simultaneously. The recording material P is taken out of a recording material accommodating cassette one by one and is conveyed to the secondary transfer portion T2 by registration rollers (conveying means) 4.

The recording material P on which the four color toner images are secondary-transferred is subjected to heat pressing by a fixing device. On a surface of the recording material P, the toner images are heat-fixed and the recording material P is discharged from discharging rollers 19 onto a discharging tray 20.

The four stations Sa, Sb, Sc and Sd have the same constitution except that the color of toners used in developing devices 14*a*, 14*b*, 14*c* and 14*d* provided to the stations Sa, Sb, Sc and Sd, respectively is different so as to be yellow for the developing device 14*a*, magenta for the developing device 14*b*, cyan for the developing device 14*c* and black for the developing device 14*d*. In the following, a most downstream station Sd will be described and with respect to other stations Sa, Sb and Sc, the suffix d of reference numerals (symbols) for representing constituent members (means) is to be read as a, b and c, respectively, for explanation of associated ones of the constituent members.

Around the photosensitive drum 11*d* at the station S2, a primary charging device 12*d*, an exposure device 13, the developing device 14*d*, a primary transfer roller 15*d* and a cleaning device 16*d* are disposed.

The photosensitive drum 11*d* is constituted by a metal cylinder on which surface a negatively chargeable photosensitive layer is formed and is rotated in a direction indicated by an arrow D at a predetermined process speed (peripheral speed: 100 mm/sec).

The primary charging device 12*d* is rotated by the photosensitive drum 11*d* by press-contact of a charging roller thereof with the photosensitive drum 11*d*. By applying a superposed voltage between a DC voltage and an AC voltage to the charging roller, the surface of the photosensitive drum 11*d* is electrically charged uniformly.

The exposure device 13 scans the charged surface of the photosensitive drum 11*d* with a laser beam, by a polygonal mirror, which has been obtained by subjecting scanning line image data expanded from a separated color image to ON-OFF modulation, so that an electrostatic image for an image is written on the charged surface of the photosensitive drum 11*d*. By the exposure, the surface of the photosensitive drum 11*d* charged to a dark portion potential VD (about −700 V) is discharged to a light portion potential VL (about −100 V) at an exposed portion and is kept at the dark portion potential VD (about −700 V) at a non-exposed portion.

The developing device 14*d* develops the electrostatic image through reverse development by depositing a negatively charged toner on the exposed portion of the electrostatic image on the photosensitive drum 11*d*. The developing device 14*d* rotates a developing sleeve carrying thereon a toner. To the developing sleeve, a voltage in the form of a negative-polarity DC voltage biased with an AC voltage is applied.

The primary transfer roller 15*d* as a primary transfer member is pressed against the photosensitive drum 11*d* through the intermediary transfer belt 1 to form the primary transfer portion T1*d* between the photosensitive drum 11*d* and the intermediary transfer belt 1. Herein, an area in which the intermediary transfer belt 1 contacts the photosensitive drum 11*d* is defined as a primary transfer portion T1.

Onto the intermediary transfer belt 1 nip-conveyed through the primary transfer portion T1*d* in superposition with the negatively charged toner image, the toner image is primary-transferred by application of a DC voltage of a positive polarity to the primary transfer roller 15*d*.

The primary transfer roller 15*d* is formed by coating a core metal with an elastic material having a medium resistance (volume resistivity: $10^4$ ohm.cm-$10^{10}$ ohm.cm). The volume resistivity was obtained by measuring a current by applying a voltage of 100 V to the core metal in a state in which the primary transfer roller 15*d* is pressed against an opposite roller with a load of 500 g-weight and is rotated at a peripheral speed of 50 mm/sec.

The cleaning device 16*d* removes a toner residual toner which passes through the primary transfer portion T1 and remains on the surface of the photosensitive drum 11*d* and then prepares for next toner image formation.

The intermediary transfer belt 1 carries the toner images primary-transferred thereon at the primary transfer portions T1*a*-T1*d* and conveys the toner images to the secondary transfer portion T2 at which secondary transfer of the toner images onto the recording material P is performed.

In the image forming apparatus 100, in order to downsize an apparatus main assembly, a distance from the primary transfer portion T1*d* of the photosensitive drum 11*d* to the secondary transfer portion T2 with respect to a movement direction of the intermediary transfer belt 1 may be 120 mm or less, preferably 90 mm or less. That is, with respect to the movement direction of the intermediary transfer belt 1, a distance between the primary transfer portion T1*d*, which is located upstream from the secondary transfer portion T2 and closest to the secondary transfer T2, and the secondary transfer portion T2 may be 120 mm or less, preferably 90 mm or less. In the image forming apparatus 100, the distance from the primary transfer portion T1*d* to the secondary transfer portion T2 was 60 mm.

With respect to the movement direction of the intermediary transfer belt 1, a distance between a central position of the primary transfer portion T1*d* and a central position of the secondary transfer portion T2 is the distance from the primary transfer portion T1*d* to the secondary transfer portion T2.

The intermediary transfer belt 1 as an example of the intermediary transfer member is supported by a driving roller 1*a*, a separation roller 1*b* and a supporting roller 1*c* under a tension of 150N and circulates at a predetermined process speed in a direction of an arrow E as an example of the intermediary transfer belt movement direction. The intermediary transfer belt 1 is prepared by forming a 20 μm-thick surface layer of a fluorine-based resin material having a volume resistivity of $10^{13}$ ohm.cm on a 0.5 mm-thick endless base layer adjusted to have a volume resistivity of $10^{7}$ ohm.cm by dispersing carbon black in hydrin rubber. The volume resistivity was measured by using a probe according to JIS-K6911 under conditions including an applied voltage of 100 V, an application time of 60 sec, a temperature of 23° C., and a humidity of 60% RH.

The intermediary transfer belt 1 can employ a resin material such as urethane-based resin, fluorine-based resin, nylon-based resin, or polyimide resin, or an elastic material such as silicone rubber or hydrin rubber. The volume resistivity of the intermediary transfer belt 1 can be adjusted by dispersing therein carbon black or electroconductive powder and may preferably be $10^{6}$ ohm.cm-$10^{12}$ ohm.cm. The tension of the intermediary transfer belt 1 varies depending on the material but may preferably be set so that an elongation percentage is 1% or less so as not to cause breaking or permanent deformation of the belt.

A secondary transfer roller 3 as an example of a secondary transfer member presses the intermediary transfer belt 1 against the separation roller 1*b* to form the secondary transfer portion T2 between the intermediary transfer belt 1 and the secondary transfer 3.

Herein, an area in which the intermediary transfer belt 1 contacts the secondary transfer roller 3 is referred to as the secondary transfer portion T2 and a position of the secondary transfer portion T2 is a central position of the secondary transfer roller 3 with respect to the movement direction of the intermediary transfer belt 1.

The secondary transfer roller 3 is constituted by coating a core metal with an electrolyte-dispersion type rubber (EPDM) foamed material having a medium resistance (volume resistivity: $10^{4}$ ohm.cm-$10^{10}$ ohm.cm).

At the secondary transfer portion T2, the recording material P is nip-conveyed in superposition with the toner images on the intermediary transfer belt 1. The toner images negatively charged on the intermediary transfer belt 1 are secondary-transferred onto the recording material P by applying a voltage of a positive polarity to the secondary transfer roller 3.

The recording material accommodating cassette 6 as a recording material accommodating portion is compatible with longitudinal feeding of an A3-size recording material and lateral feeding of an A4-size recording material and is capable of stacking recording materials P of various sizes.

A separating device 5 takes the recording material P out of the recording material accommodating cassette 6 and separates the recording material P one by one to feed the recording material to registration rollers 4.

The registration rollers 4 receives the recording material in a rest state to stand by and then nip-conveys the recording material P in synchronism with the toner images on the intermediary transfer belt 1 to feed the recording material to the secondary transfer portion T2.

The separating roller 1*b* bends a circulating path of the intermediary transfer belt 1 on a downstream side of the secondary transfer portion T2 and separates the recording material P from the intermediary transfer belt 1 by curvature.

The fixing device 17 receives and heat-presses the recording material P on which the toner images are secondary-transferred at the secondary transfer portion T2 to fix the toner images on the surface of the recording material P.

A discharging roller 19 discharges the recording material P, on which the toner images are fixed, onto a discharging tray 20 to be stacked.

A cleaning device 18 abuts a rubber-made cleaning blade 18*a* against the intermediary transfer belt 1 supported by the supporting roller 1*c*. The cleaning blade 18*a* scrapes the transfer residual toner, which passes through the secondary transfer portion T2 and remains on the intermediary transfer belt 1, into a residual toner box 18*b* to cause the intermediary transfer belt 1 to prepare for next primary transfer.

Sheet Interval Control

Figure 2:
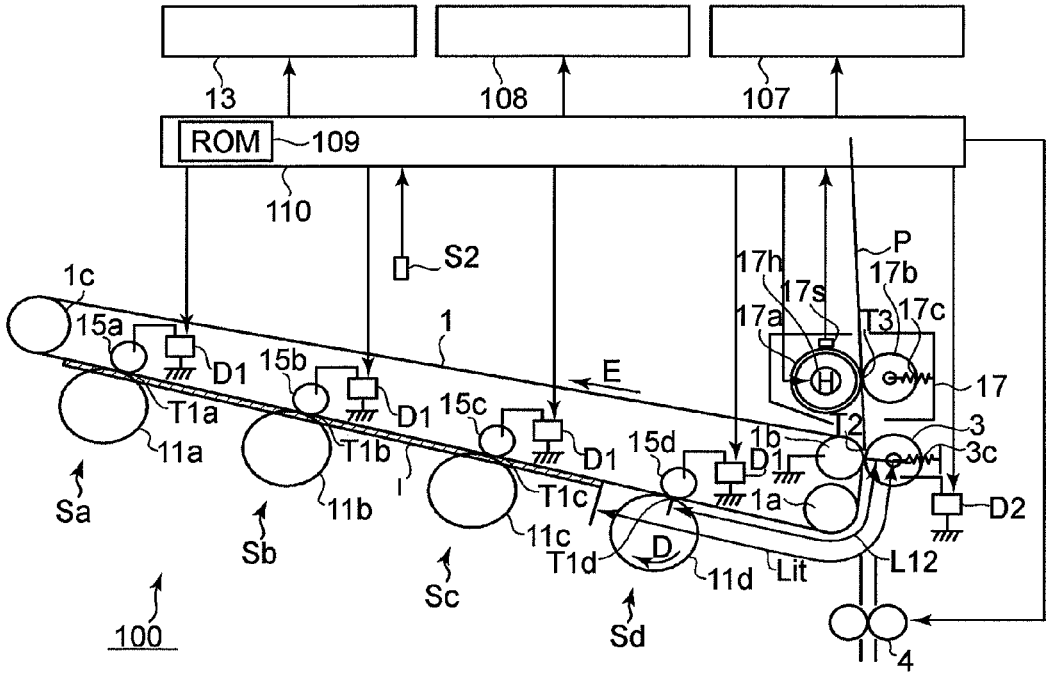
FIG. 2 is a schematic view for illustrating arrangement of primary transfer portions and a secondary transfer portion along an intermediary transfer belt.
Figure 3:
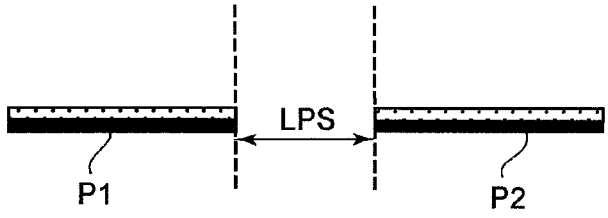
FIG. 3 is a schematic view for illustrating a sheet interval.
Figure 4:
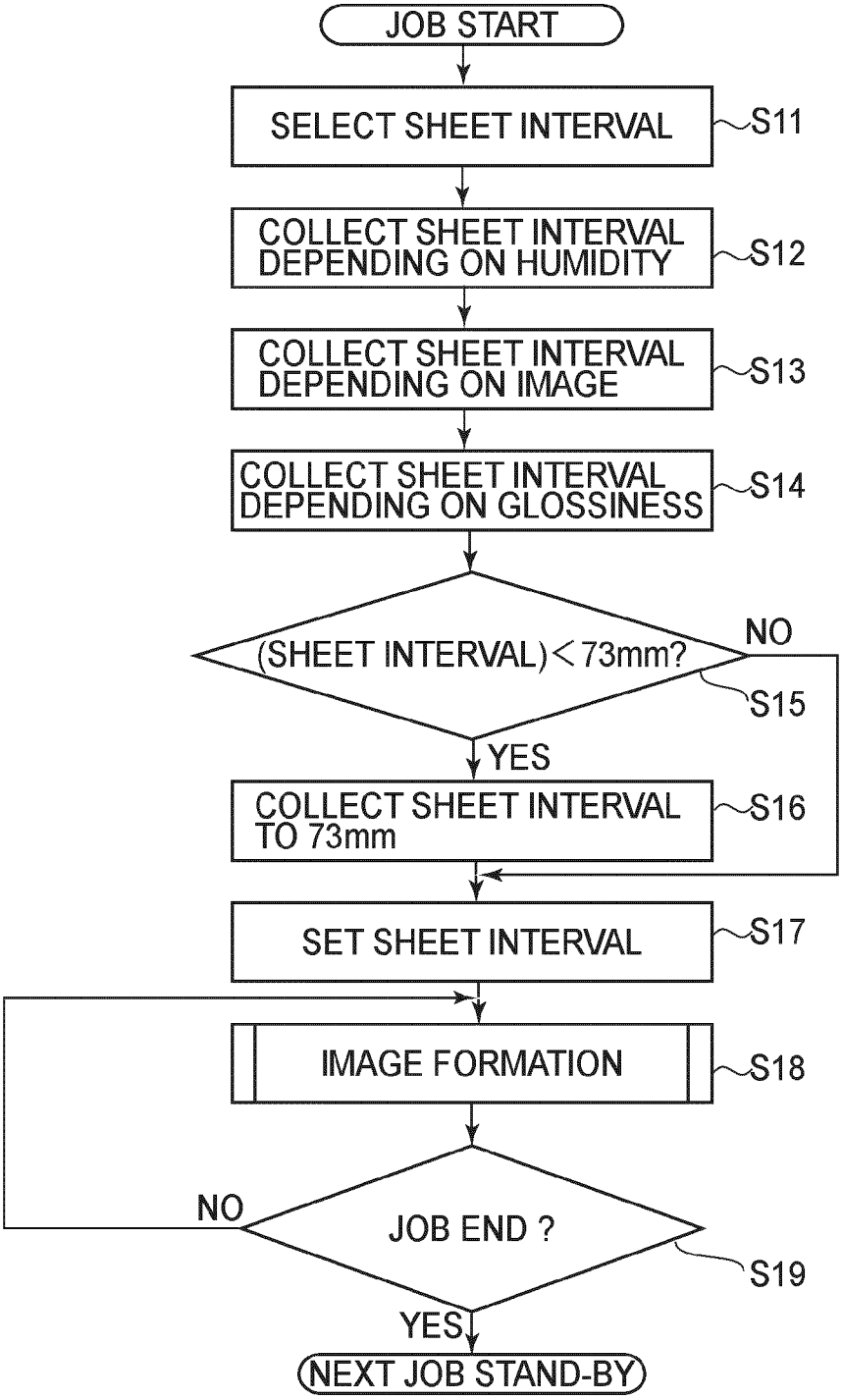
FIG. 4 is a flowchart of sheet interval control.
Figure 5:
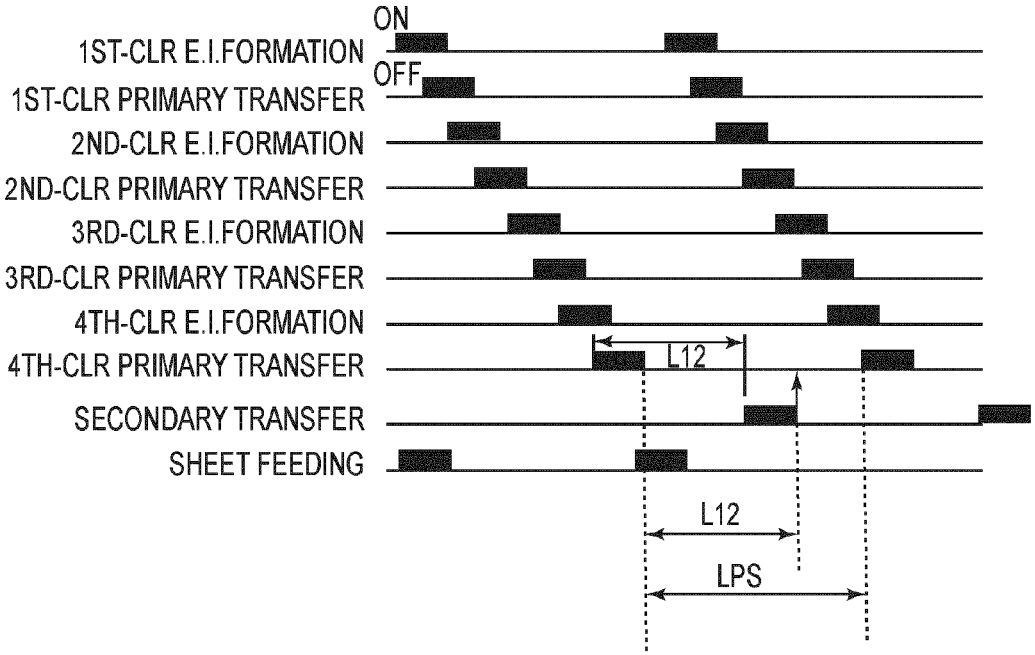
FIG. 5 is a time chart of sheet interval control.

FIG. 2 is an illustration of the arrangement of the primary transfer portions and the secondary transfer portion along the intermediary transfer belt, FIG. 3 is an illustration of a sheet interval, FIG. 4 is a flowchart of sheet interval control, and FIG. 5 is a time chart of the sheet interval control.

As shown in FIG. 2, along the circulating path of the intermediary transfer belt 1, the photosensitive drums 11*a*, 11*b*, 11*c* and 11*d* are arranged to form the primary transfer portions T1*a*, T1*b*, T1*c* and T1*d*, respectively.

The secondary transfer roller 3 as the example of the secondary transfer member is urged by an urging spring (spring member) 3*c* to press-contact the intermediary transfer belt 1 supported by the separating roller 1*b*.

A control portion 110 causes a positive-polarity voltage to be outputted from a power source D1 to the primary transfer rollers 15*a*, 15*b*, 15*c* and 15*d*, so that the negative toner images carried on the photosensitive drums 11*a*, 11*b*, 11*c* and 11*d* are primary-transferred onto the intermediary transfer belt 1.

The control portion 110 causes a positive-polarity voltage to be outputted from a power source D2 to the secondary transfer roller 3, so that the negative toner images carried on the intermediary transfer belt 1 are secondary-transferred onto the recording material P.

In the fixing device 17, a pressing roller 17*b* press-contacts a heating roller 17*a*, in which a lamp heater 17*h* is disposed, by an urging spring 17*c* to form a fixing portion T3.

The control portion 110 controls an image forming operation. On the basis of a detection output of a temperature sensor 17*s* disposed downstream from the fixing portion T3, the control portion 110 effects ON-OFF control of the lamp heater 17*h* to control a temperature of the fixing portion T3 to a predetermined temperature range.

The control portion 110 sets an interval of electrostatic images to be written in the photosensitive drums 11*a*, 11*b*, 11*c* and 11*d* by controlling the exposure device 13. The interval of the electrostatic images written in the photosensitive drums 11*a*, 11*b*, 11*c* and 11*d* corresponds to an interval of toner images developed from the electrostatic images, thus resulting in an interval of the toner images primary-transferred on the intermediary transfer belt 1. The interval of the toner images primary-transferred on the intermediary transfer belt 1 corresponds to an interval of the recording material P to be fed to the secondary transfer portion T2 by the registration rollers 4, i.e., a sheet interval.

The control portion 110 as a recording material interval control portion variably sets a conveying interval during continuous conveyance (feeding) of the recording material P to the secondary transfer portion T2 by the registration rollers 4 as a conveying (feeding) means (hereinafter referred to as an "sheet interval"). The control portion 110 sets a toner image forming interval by discriminating a type of the recording material P, a water content in the ambient air, an ambient temperature, a type of an image, and a finishing glossiness of the image, thus setting the sheet interval depending on the toner image forming interval.

In the case of thick paper or a resin sheet, a fixing load is large when compared with plain paper, so that the sheet interval is set to be large to prevent a lowering in temperature at the fixing portion T3.

Paper takes up moisture in the case where the water content in the ambient is large and a heating quantity is increased in the case of a low ambient temperature, so that a fixing load is increased in either case. Therefore, the sheet interval is set to be large to prevent the lowering in temperature at the fixing portion T3.

In the case where the finishing glossiness is set at a level of gloss finish, the fixing load is increased, so that the temperature at the fixing portion T3 is increased by setting the sheet interval to be large.

However, a minimum of the sheet interval variably set by the control portion 110 is larger than a distance L12 from the primary transfer portion T1*d* of the photosensitive drum 11*d* to the secondary transfer portion T2. Even in the case of an image forming condition and the type of the recording material which presents no problem of the temperature lowering at the fixing portion T3 and in the case where there is a margin of throughput of the fixing device 17, the sheet interval is not set to be not more than the distance L12 from the primary transfer portion T1*d* to the secondary transfer portion T2. Thus, the image forming apparatus has a continuous image forming mode in which sheets of the recording material are continuously passed with a preset minimum of the sheet interval, so that it is possible to enhance productivity while the influence on the image is reduced. In this embodiment, in the continuous image forming mode, such a constitution that, in addition to the minimum sheet interval, a part of the sheet interval is provided to be larger than the minimum in order to adjust the image forming portion, may also be employed.

As shown in FIG. 3, the image forming apparatus 100 (FIG. 1) effects a so-called frameless printing such that an image is formed on a whole surface of the recording material P. Therefore, when a trailing end of a recording material P passes through the secondary transfer portion T2, a distance Lit (FIG. 2) from the trailing end of the recording material P to a leading end of an image area I in which a subsequent toner image to be supplied to secondary transfer has been primary-transferred is equal to a sheet interval LPS (FIG. 3).

The control portion 110 starts the primary transfer of the toner images at the primary transfer portion T1*d* of the photosensitive drum 11*d* after the recording material P passes through the secondary transfer portion T2 by setting the sheet interval so as not to be not more than L12. That is, when the trailing end of the recording material P has passed through the secondary transfer portion T2, a minimum of the distance Lit is longer than the sheet interval LPS.

By this, the control portion 110 effects control so that the recording material P does not pass through the secondary transfer portion T2 during when the primary transfer of the toner images is performed at the primary transfer portion T1*d* of the photosensitive drum 11*d*.

The control portion 110 executes the primary transfer while avoiding the influence of vibration (speed fluctuation) occurring with respect to the intermediary transfer belt 1 by a collision or the like of the secondary transfer roller 3 with the intermediary transfer belt 1 at the moment when the recording material P has passed through the secondary transfer portion T2.

The control portion 110 controls the exposure device 13 to adjust writing start timing with respect to the photosensitive drum 1, so that the control portion 110 sets, as shown in FIG. 3, a sheet interval with the distance (interval) LPS from a preceding recording material P1 and a recording material P2 subsequent to the recording material P1.

As shown in FIG. 2, the distance from the primary transfer portion T1*d* of the photosensitive drum 11*d*, on which the final color toner image is primary-transferred, to the secondary transfer portion T2 is L12. As shown in FIG. 3, the sheet interval from the trailing end of an image to the leading end of a subsequent image during the continuous image formation is LPS. The control portion 110 sets the sheet interval so as to ensure the following relationship:

$$0<L12<LPS \quad (1).$$

The control portion 110 executes the continuous image forming mode with this sheet interval.

As shown in FIG. 4 with reference to FIG. 2, the control portion 110 selects a sheet interval Lp1 depending on the type and size of the recording material when it receives a job for image formation (S11). In a storing device 109, a plurality of data on the sheet interval Lp1 for each of a combination of the type of the recording material and the size of the recording material is stored in advance. The control portion 110 selects the sheet interval Lp1 depending on the type and size of the recording material set through a recording material data contained in the job data or through an operation panel.

Then, the control portion 110 performs a correction operation (computation) of the sheet interval Lp1 depending on an absolute humidity and an ambient temperature calculated from a temperature/humidity sensor S2 to determine a sheet interval Lp2 (S12).

The control portion 110 performs a correction operation of the sheet interval Lp2 depending on image type data contained in the job data to determine a sheet interval Lp3 (S13).

The control portion 110 performs a correction operation of the sheet interval Lp3 depending on finishing glossiness data contained in the job data to determine a sheet interval Lp4 (S14).

The control portion 110 discriminates whether or not the sheet interval Lp4 is less than 73 mm (S15). In the case where the sheet interval Lp4 is less than 73 mm (YES in S15), the sheet interval Lp4 is changed to 73 mm (S16).

The control portion 110 sets the sheet interval Lp4 as a final sheet interval LPS (S17) and carries out image formation by controlling the exposure device 13 with the sheet interval LPS (S18).

The control portion 110 repeats the image formation with the sheet interval LPS until the job is completed (NO in S19). When the job is completed (YES in S19), the control portion stands by for a next job.

As shown in FIG. 5 with reference to FIG. 2, a first color toner image is started to be primary-transferred from the photosensitive drum 11*a* to the intermediary transfer belt 1 during writing, by the exposure device 13, of an electrostatic image (E.I.) for a first color of an image of a first sheet.

With respect to the photosensitive drum 11*b*, the exposure device 13 starts writing of an electrostatic image for a second color of the image of the first sheet with a delay corresponding to a distance between the primary transfer portion T1*a* of the photosensitive drum 11*a* and the primary transfer portion T1*b* of the photosensitive drum 11*b*.

By this, at the primary transfer portion T1*b* of the photosensitive drum 11*b*, a second color toner image is superposed and primary-transferred on the first color toner image on the intermediary transfer belt 1.

With respect to the photosensitive drum 11*c*, the exposure device 13 starts writing of an electrostatic image for a third color of the image of the first sheet with a delay corresponding to a distance between the primary transfer portion T1*b* of the photosensitive drum 11*b* and the primary transfer portion T1*c* of the photosensitive drum 11*c*.

By this, at the primary transfer portion T1*c* of the photosensitive drum 11*c*, a third color toner image is superposed and primary-transferred on the second color toner image on the intermediary transfer belt 1.

With respect to the photosensitive drum 11*d*, the exposure device 13 starts writing of an electrostatic image for a fourth color of the image of the first sheet with a delay corresponding to a distance between the primary transfer portion T1*c* of the photosensitive drum 11*c* and the primary transfer portion T1*d* of the photosensitive drum 11*d*.

By this, at the primary transfer portion T1*d* of the photosensitive drum 11*d*, a fourth color toner image is superposed and primary-transferred on the third color toner image on the intermediary transfer belt 1.

When a leading end of the fourth color toner image is conveyed by the distance L12, the leading end reaches the secondary transfer portion T2, at which secondary transfer is started. The distance L12 actually corresponds to a time obtained by dividing the distance L12 by a process speed but in this embodiment, the time is represented in terms of the distance.

On the photosensitive drums 11*a*, 11*b*, 11*c* and 11*d*, color electrostatic images for an image of a second sheet are written (formed), respectively, after a circumferential rotation corresponding to the sheet interval LPS. The resultant toner images are primary-transferred onto the intermediary transfer belt 1, respectively.

When the secondary transfer of the toner images for the image of the first sheet is completed and a trailing end of the recording material P passes through the secondary transfer portion T2, at the primary transfer portion T1*b* of the photosensitive drum 11*b*, the toner image for the image of the second sheet has been primary-transferred. However, the sheet interval LPS is set to be larger than the distance L12 (=60 mm), so that the primary transfer of the toner image for the image of the second sheet is not started at the primary transfer portion T1*d* of the photosensitive drum 11*d*. After the recording material passes through the secondary transfer portion, the primary transfer of the fourth color toner image is started.

Therefore, vibration (tension fluctuation) which occurs at the secondary transfer portion T2 when the secondary transfer of the toner images for the image of the first sheet is completed and which is transmitted through the intermediary transfer belt 1 does not influence the primary transfer at the primary transfer portion T1*d* of the photosensitive drum 11*d*.

As described later, by a nip at the primary transfer portion T1*d* of the photosensitive drum 11*d*, the vibration (tension fluctuation) of the intermediary transfer belt 1 is prevented from transmitting toward an upstream side. For this reason, there is no influence of the vibration on the toner image primary-transferred on the intermediary transfer belt 1 at the primary transfer portion T1*d* of the photosensitive drum 11*d* at least at an eye observation level. As described later, also in the case where the toner image is primary-transferred on the intermediary transfer belt 1 at the primary transfer portion T1*c* of the photosensitive drum 11*c*, an adverse influence of the vibration on the toner image was not observed.

Comparative Experiment with Comparative Embodiment

Figure 6:
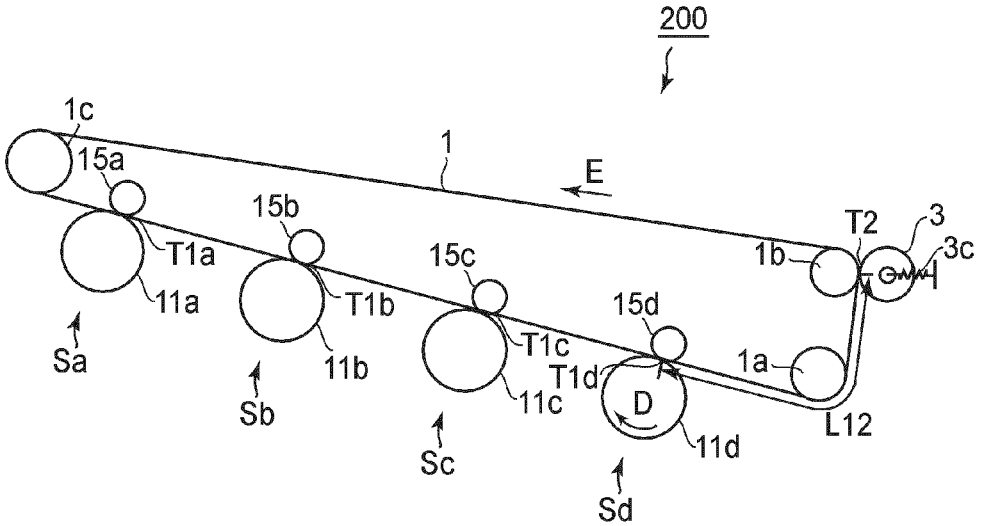
FIG. 6 is a schematic view for illustrating a structure of an image forming apparatus of Comparative Embodiment.
Figure 7:
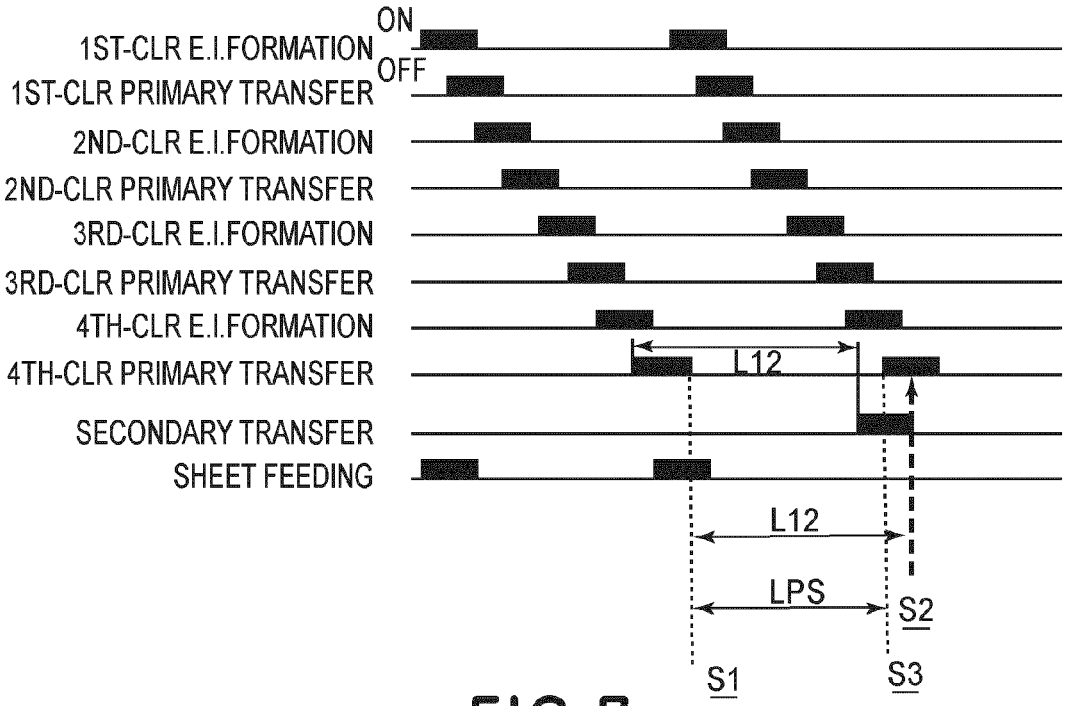
FIG. 7 is a time chart in Comparative Embodiment in the case where sheet interval control similar to that in First Embodiment is performed.
Figure 8:
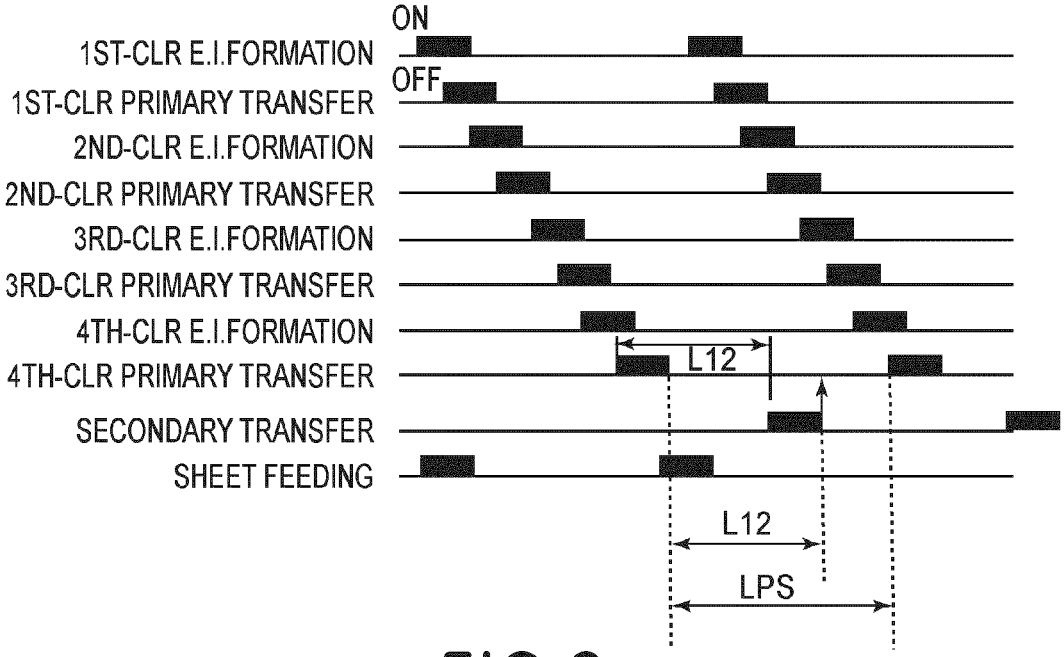
FIG. 8 is a time chart in the case where image formation on thick paper is performed in Comparative Example.

FIG. 6 is an illustration of a structure of an image forming apparatus of Comparative Embodiment, FIG. 7 is a time chart in the case where sheet interval control similar to that in First Embodiment is carried out in Comparative Embodiment, and FIG. 8 is a time chart in the case of performing image formation on thick paper in Comparative Embodiment.

As shown in FIG. 6, an image forming apparatus 200 of Comparative Embodiment has a distance L12, between the primary transfer portion T1*d* of the photosensitive drum 11*d* and the secondary transfer portion T2, longer than that of the image forming apparatus 100 of First Embodiment. Other constituents of Comparative Embodiment are the same as those of First Embodiment, so that common portions shown in FIG. 1 are omitted from redundant explanation. In FIG. 6, constituents common to FIG. 2 and FIG. 6 are represented by common reference numerals and redundant explanation will be omitted. Further, in description with reference to FIG. 7, redundant explanation on FIG. 5 will be also omitted.

In the thus structured image forming apparatus 200 of Comparative Embodiment, sheet interval control similar to that by the image forming apparatus 100 (FIG. 1) of First Embodiment is carried out and output images in Comparative Embodiment were compared with those in First Embodiment.

The image forming apparatus 200 of Comparative Embodiment has the distance L12, from the primary transfer portion T1*d* of the photosensitive drum 11*d* to the secondary transfer portion T2, larger than an sheet interval LPS during continuous image formation at a maximum speed. That is, the distance L12 and the sheet interval LPS satisfy the following relationship:

$$L12>LPS \quad (2).$$

When the description is made by numerical values, the distance L12 from the primary transfer portion T1*d* of the photosensitive drum 11*d* in First Embodiment is 60 mm, whereas the distance L12 in 90 mm in Comparative Embodiment. Further, in Comparative Embodiment, sheet interval control with a lower limit of the sheet interval LPS of 73 mm described with reference to FIG. 4 is carried out.

A comparative experiment between First Embodiment and Comparative Embodiment was performed by cross (lateral) feeding of A4-size plain paper as a higher-speed paper type. A process speed was set at 140 mm/sec and the number of output sheets per minute (productivity) was set at 30 sheets/min. By this, a conveyance pitch of the recording material is 282 mm, so that a sheet interval LPS of 73 mm is ensured as an interval for the recording material having a width (length) of 209 mm with respect to the cross feeding direction.

The registration rollers 4 feed the recording material P to the secondary transfer portion T2 with the sheet interval of 73 mm, so that the fixing device 17 receives the recording material P with the sheet interval of 73 mm.

A comparison result between output images in First Embodiment and output images in Comparative Embodiment is shown in Table 1. In Table 1, "A" represents that an image defect was not observed, and "B" represents that the image defect was observed.

TABLE 1

| EMB. | Station 1st | 2nd | 3rd | 4th |
|---|---|---|---|---|
| First EMB. | A | A | A | A |
| Comp. EMB. | A | A | A | B |

As shown in Table 1, in Comparative Embodiment, a striped pattern-like image defect of the black image formed at the fourth station Sd with respect to a direction perpendicular to a conveyance direction of the recording material was observed. The striped pattern-like image defect is considered that it occurs in the following manner.

As shown in FIG. 5, in First Embodiment, in the case of the continuous image formation with the sheet interval of 73 mm, the primary transfer of the toner image for the image of the second sheet is not started at the primary transfer portion T1*d* of the photosensitive drum 11*d* when the secondary transfer of the toner images for the image of the first sheet is completed. This is because the distance L12 from the primary transfer portion T1*d* of the photosensitive drum 11*d* to the secondary transfer portion T2 is 60 mm, which is smaller than the sheet interval of 73 mm.

However, as shown in FIG. 7, in Comparative Embodiment, in the case of the continuous image formation with the sheet interval of 73 mm, the primary transfer of the toner image for the image of the second sheet has already proceeded by 17 mm when the secondary transfer of the toner images for the image of the first sheet is completed. This is because the distance L12 from the primary transfer portion T1*d* of the photosensitive drum 11*d* to the secondary transfer portion T2 is 90 mm, which is larger than the sheet interval of 73 mm by 17 mm.

Therefore, as shown in FIG. 6, the vibration (tension fluctuation) of the intermediary transfer belt 1 occurring when the recording material has passed through the secondary transfer portion T2 causes density non-uniformity due to the vibration in the toner image primary-transferred on the intermediary transfer belt 1 at the primary transfer portion T1*d* of the photosensitive drum 11*d*.

When the recording material has passed through the secondary transfer portion T2, the secondary transfer roller which has failed to contact the recording material collides violently with the intermediary transfer belt 1 to generate spike-like vibration (tension fluctuation) of the intermediary transfer belt 1. On the other hand, when the recording material has entered the secondary transfer portion T2, an impact is distributed, so that the vibration (tension fluctuation) of the intermediary transfer belt 1 does not reach such a level that the image defect is observable at least with eyes.

Further, as for the images primary-transferred at the first to third stations Sa, Sb and Sc, the image defect is not caused to occur both in First Embodiment and Comparative Embodiment. This is because a distance from the secondary transfer portion T2 is sufficiently long to attenuate the impact and the primary transfer portion T1*d* at the fourth station Sd absorbs the impact.

Next, the case where continuous image formation on A4-size thick paper is performed in the image forming apparatus 200 of Comparative Embodiment, when the thick paper is set as the recording material, as described with reference to FIG. 4, the control portion 110 (FIG. 2) sets the sheet interval LPS larger than that in the case of the plain paper. This is because the thick paper provides a large fixing load to the fixing device 17, so that a temperature of the fixing portion T3 (FIG. 2) is lowered when the sheet interval LPS is short, thus resulting in an occurrence of fixing failure.

As shown in FIG. 8, in the case where the A4-size thick paper is set as the recording material, the process speed of 140 mm/sec is not changed and the number of output sheets per minute is lowered to 20 sheets/min. In this case, the conveyance pitch of the recording material is 400 mm or more, so that it is possible to ensure a sheet interval LPS exceeding 200 mm as an interval for the recording material having the width (length) of 209 mm with respect to the cross feeding direction.

As shown in FIG. 6, in this case, the relationship: L12< LPS . . . (1) is satisfied, so that the primary transfer is not started at the primary transfer portion T1*d* of the photosensitive drum 11*d* when the recording material has passed through the secondary transfer portion T2. For this reason, similarly as in First Embodiment, there is no influence on the toner image primary-transferred on the intermediary transfer belt 1 at the primary transfer portion T1*d* of the photosensitive drum 11*d*.

Therefore, in the image forming apparatus 100 of First Embodiment, the distance L12 between the primary transfer portion T1*d* of the photosensitive drum 11*d* and the secondary transfer portion T2 was 60 mm shorter than 90 mm in Comparative Embodiment, so that it was possible to set the sheet interval LPS at 73 mm without impairing the image. The sheet interval LPS was able to be set at 73 mm, so that it was possible to perform high-speed processing of 30 sheets/min at the process speed of 140 mm/sec with respect to the A4-size plain paper without impairing the image.

In first Embodiment, the exposure device 13 and the developing device 14*d* as examples of the toner image forming means form the toner image on the photosensitive drum 11*d* as the example of the image bearing member. The intermediary transfer belt 1 as the example of the intermediary transfer member conveys the toner image, carried thereon at the primary transfer T1*d* as the example of the primary transfer portion to the secondary transfer portion T2 as the example of the secondary transfer portion.

The primary transfer roller 15*d* as the primary transfer member electrically moves the toner image to the intermediary transfer member in a state in which the intermediary transfer member is pressed against the intermediary transfer belt at the primary transfer portion. Further, the secondary transfer roller 3 as the example of the secondary transfer means moves the toner images to the recording material at the secondary transfer portion in a state in which the recording material is caused to press-contact the intermediary transfer member.

The fixing device 17 heat-presses the recording material on which the toner images are secondary-transferred to fix the toner images on the recording material.

The control portion 110 as an example of an interval changing means variably sets the toner image forming interval with respect to the image bearing member. However, a minimum toner image forming interval set by the control portion 110 is larger than a length of the intermediary transfer belt between the primary transfer portion and the secondary transfer portion.

The minimum toner image forming interval set by the control portion 110 is smaller than a length of the intermediary transfer belt between the second-closest primary transfer portion to the secondary transfer portion T2 as the example of the secondary transfer portion and the secondary transfer portion T2. The control portion 110 sets the toner image forming interval by adding a margin length created on a subsequent recording material to the sheet interval.

Incidentally, the secondary transfer roller 3 press-contacts the intermediary transfer member by spring urging and effects the secondary transfer at the secondary transfer portion T2 by pressing the intermediary transfer belt 1 against the recording material P under a relatively high pressure. For this reason, when the recording material P has passed through the secondary transfer portion T2, a braking force for stopping travelling of the intermediary transfer belt 1 is generated at the secondary transfer portion T2, so that a belt tension is abruptly decreased on a tension side and is abruptly increased on a loose side. Further, a pressure at the secondary transfer portion T2 abruptly fluctuates depending on the presence or absence of the recording material P.

As a result, impact vibration occurs in the intermediary transfer belt 1 and transmits to the photosensitive drum 11 through the intermediary transfer belt 1, thus causing local image deteriorations of the toner images during the primary transfer. The first deteriorations such as an occurrence of "color misregistration" such that positional deviation occurs among the respective color toner images, an occurrence of "color unevenness" such that the coloring is delicately changed, and an occurrence of a very discomfortable striped pattern on a background color, are liable to occur.

However, in First Embodiment, it was possible to realize further downsizing and high productivity (the number of output sheets per minute) compared with the case of the image forming apparatus 200 of Comparative Embodiment while these image deteriorations were prevented.

Modified Embodiment of First Embodiment

In First Embodiment, the image defect was prevented by effecting the control such that the lower limit of the sheet interval LPS was 73 mm. This control is effected in order that the image defects are not caused to occur in an area including a frame portion based on the assumption that a frameless solid image would be formed.

However, in ordinary image formation for a character image or the like, a margin portion is created at a leading end and a trailing end of the A4-size recording material with respect to the conveyance direction, so that it is possible to further shorten the sheet interval by a width of the margin portion.

This is because, as shown in FIG. 2, even if the intermediary transfer belt 1 transmits the vibration when the margin portion of the image passes through the primary transfer portion T1*d* of the photosensitive drum 11*d*, the toner image leading to the image defect is not present at the margin portion.

Therefore, with respect to the sheet interval in the flowchart of FIG. 4, it is possible to effect the sheet interval control avoiding the image defect even when the sheet interval is replaced by a distance between images (image interval) written by the exposure device 13.

The control portion 110 discriminates a margin length Ly (not shown), of the leading end with respect to the conveyance direction, from image data of an image to be formed and sets an image interval shorter than 73 mm by the margin length Ly as the lower limit.

As described above, also in this modified embodiment, the minimum of the distance Lit is longer than the sheet interval LPS when the trailing end of the recording material P has passed through the secondary transfer portion T2.

By this, the recording material P is controlled so as not to pass through the secondary transfer portion T2 during the primary transfer at the primary transfer portion T1*d* of the photosensitive drum 11*d*.

In First Embodiment, the sheet interval LPS was set by discriminating the type of the recording material. However, depending on a detection result of a temperature of the fixing device 17, control such that the toner image forming interval on the photosensitive drum 11*d* is variably set may also be employed.

That is, it is possible to employ such a modified embodiment that the control portion 110 variably sets the toner image forming interval on the photosensitive drum 11*d* on the basis of a detection output of the temperature sensor 17*s* (FIG. 2) disposed downstream from the fixing portion T3.

When a job is inputted, the control portion 110 starts continuous image formation with a sheet interval LPS exceeding 200 mm which causes no problem even for the thick paper.

Further, when an ON-OFF duty of the lamp heater 17*h* allows a margin and the detection output of the temperature sensor 17*s* is kept at a level equal to or more than a predetermined temperature, there is room to shorten the sheet interval LPS.

Therefore, the control portion 110 executes the image formation for the job by re-setting the sheet interval LPS to be shortened little by little until the detection output of the temperature sensor 17*s* is lowered to the lower limit satisfying a required fixing process quality.

By this, it is possible to carry out the sheet interval control without discriminating the type of the recording material. Further, the sheet interval control may also be carried out by combining the discrimination of the type of the recording material with the detection output of the temperature sensor 17*s*.

Second Embodiment

Figure 9:
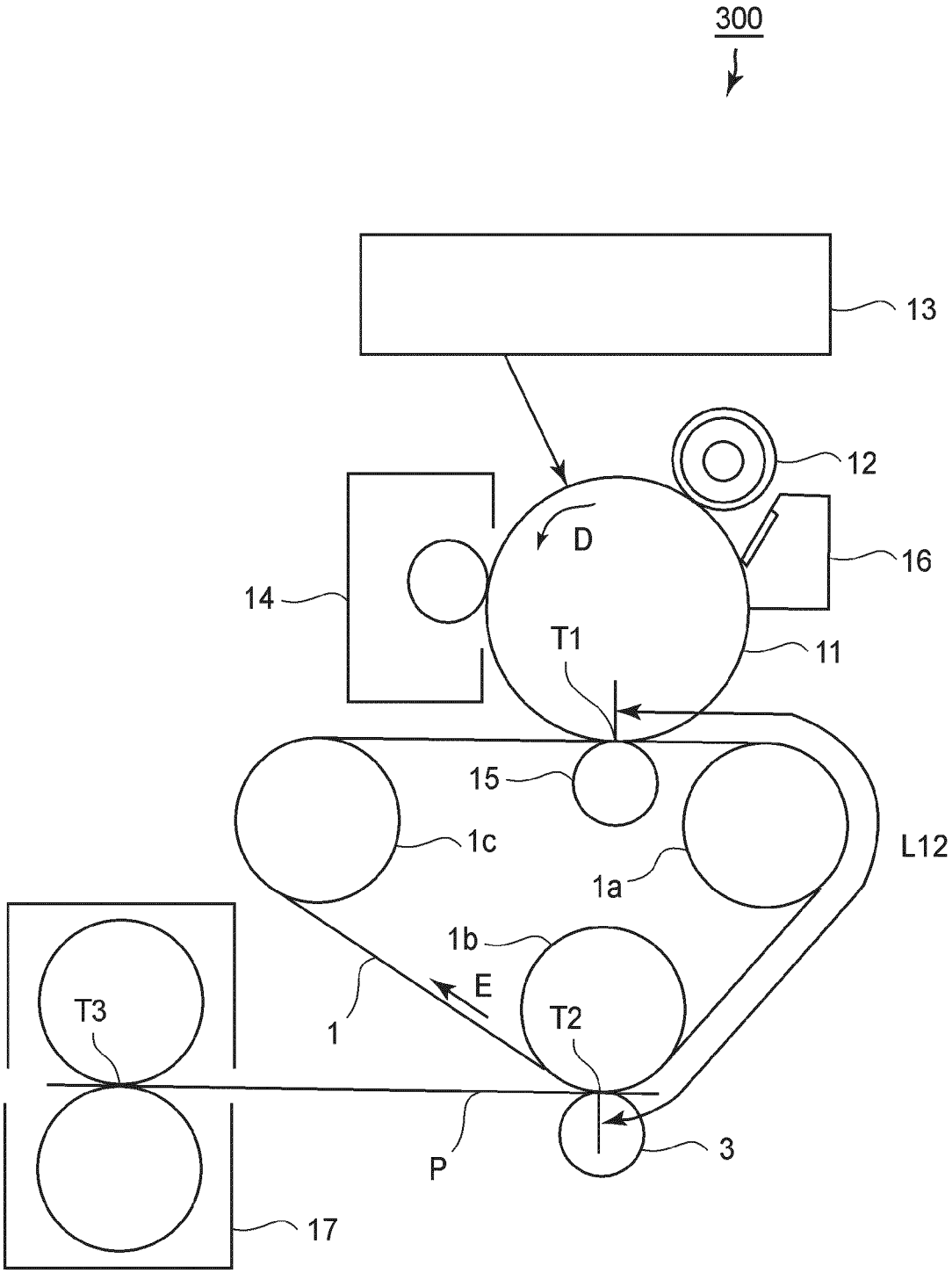
FIG. 9 is a schematic view for illustrating a structure of an image forming apparatus of Second Embodiment.

FIG. 9 is an illustration of a structure of an image forming apparatus of Second Embodiment. An image forming apparatus 300 of this embodiment is a monochromatic printer using an intermediary transfer belt 1.

As shown in FIG. 9, a toner image formed on a photosensitive drum 11 rotating in an arrow D direction is primary-transferred onto the intermediary transfer belt 1 rotating in an arrow E direction by applying a voltage of an opposite polarity to that of the toner image to a primary transfer roller 15. The toner image primary-transferred on the intermediary transfer belt 1 at a primary transfer portion T1 is carried on the intermediary transfer belt 1 and conveyed by the intermediary transfer belt 1 to a secondary transfer portion T2 and is nip-conveyed in superposition with a recording material P at the secondary transfer T2. At the secondary transfer portion T2, by applying a voltage of an opposite polarity to that of the toner image to a secondary transfer roller 3, the toner image on the intermediary transfer belt 1 is secondary-transferred onto the recording material P.

The recording material P on which the toner image is secondary-transferred is sent into a fixing device 17 and heat-pressed at a fixing portion T3, so that the toner image is fixed on a surface of the recording material P.

The photosensitive drum 11 is constituted by a metal cylinder and is rotated at a predetermined process speed.

A primary charging device 12 is rotated by the photosensitive drum 11 by press-contact of a charging roller thereof with the photosensitive drum 11. By applying a superposed voltage between a DC voltage and an AC voltage to the charging roller, the surface of the photosensitive drum 11 is electrically charged uniformly.

An exposure device 13 scans the charged surface of the photosensitive drum 11 with a laser beam, by a polygonal mirror, which has been obtained by subjecting scanning line image data expanded from a separated color image to ON-OFF modulation, so that an electrostatic image for an image is written on the charged surface of the photosensitive drum 11.

A developing device 14 develops the electrostatic image through reverse development by depositing an electrically charged toner on the electrostatic image on the photosensitive drum 11.

In the image forming apparatus 300 of this embodiment, in order to downsize an apparatus main assembly, a distance L12 from the primary transfer portion T1 of the photosensitive drum 11 to the secondary transfer portion T2 with respect to a movement direction of the intermediary transfer belt 1 may be 120 mm or less. In the image forming apparatus 300, the distance L12 from the primary transfer portion T1 to the secondary transfer portion T2 is 100 mm.

In the image forming apparatus 300, a condition such that a defect at an eye-observation level was not caused to occur in an output image was obtained by changing the sheet interval stepwisely in an experiment. The recording material P was A4-size plain paper and a frameless solid image was formed at a process speed of 200 mm/sec. The result of the experiment is shown in Table 2.

TABLE 2

| | S.I*[1] (mm) | | | | | | | | |
|---|---|---|---|---|---|---|---|---|---|
| | 50 | 60 | 70 | 80 | 90 | 100 | 110 | 120 | 130 |
| Image Evaluation | B | B | B | B | B | A | A | A | A |

*[1]"S.I." represents a sheet interval.

In Table 2, "A" represents that there is no image defect, and "B" represents that the image defect occurs. As shown in Table 2, in the case where the sheet interval is less than 100 mm, similarly as in First Embodiment, linear density non-uniformity with respect to a direction perpendicular to the conveyance direction of the recording material P was observed. Further, when the sheet interval was 90 mm, density non-uniformity occurred at the leading end of the recording material P and was shifted toward a central portion with a decreasing sheet interval.

Therefore, in the image forming apparatus 300 of Second Embodiment, the lower limit of the sheet interval was 100 mm, so that the image formation was not carried out with the sheet interval of less than 100 mm.

Also in Second Embodiment, the frameless printing is performed. For this reason, when the trailing end of the recording material P has passed through the secondary transfer portion T2, a distance Lit from the trailing end of the recording material P to a leading end of an image area on which a toner image to be subsequently subjected to the secondary transfer has been primary-transferred is equal to the sheet interval LPS.

By this, the recording material P is controlled so as not to pass through the secondary transfer portion T2 during the primary transfer at the primary transfer portion T1 of the photosensitive drum 11.

Third Embodiment

Figure 10:
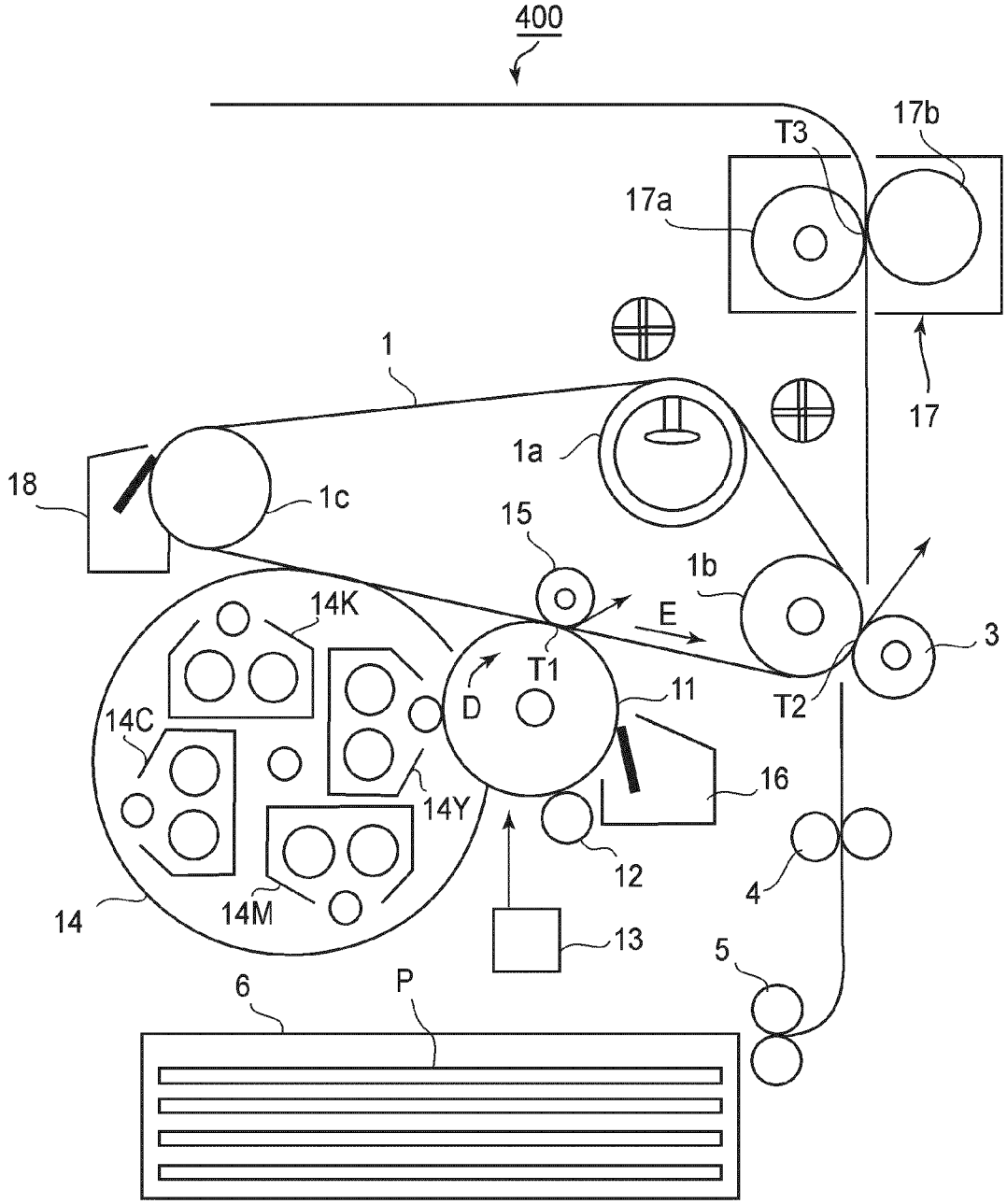
FIG. 10 is a schematic view for illustrating a structure of an image forming apparatus of Third Embodiment.

FIG. 10 is an illustration of a structure of an image forming apparatus of Third Embodiment. An image forming apparatus 400 of this embodiment is a color printer including a rotary type developing device 14.

As shown in FIG. 10, the image forming apparatus 400 forms color toner images of yellow, magenta, cyan and black in turn on a photosensitive drum 11 rotating in an arrow D direction and then successively primary-transfers the respective color toner images onto an intermediary transfer belt 1 rotating in an arrow E direction in a superposition manner. The four color toner images primary-transferred on the intermediary transfer belt 1 are simultaneously secondary-transferred onto a recording material P at a secondary transfer portion T2. The recording material P on which the four color toner images are secondary-transferred is heat-pressed at a fixing portion T3 of a fixing device 17, so that the toner images are fixed on a surface of the recording material P.

The photosensitive drum 11 is constituted by a metal cylinder and is rotated in the arrow D direction at a predetermined process speed.

A primary charging device 12 is rotated by the photosensitive drum 11 by press-contact of a charging roller thereof with the photosensitive drum 11 and electrically charges a surface of the photosensitive drum 11 uniformly.

An exposure device 13 scans the charged surface of the photosensitive drum 11 with a laser beam, so that an electrostatic image for an image is written on the charged surface of the photosensitive drum 11.

The developing device 14 positions a yellow developing device 14Y, a magenta developing device 14M, a cyan developing device 14C and a black developing device 14K in a developing position by rotation.

The yellow developing device 14Y develops the electrostatic image into a yellow toner image by depositing an electrically charged yellow toner on the electrostatic image on the photosensitive drum 11.

The magenta developing device 14M develops the electrostatic image into a magenta toner image by depositing an electrically charged magenta toner on the electrostatic image on the photosensitive drum 11.

The cyan developing device 14C develops the electrostatic image into a cyan toner image by depositing an electrically charged cyan toner on the electrostatic image on the photosensitive drum 11.

The black developing device 14Y develops the electrostatic image into a black toner image by depositing an electrically charged black toner on the electrostatic image on the photosensitive drum 11.

A cleaning device 16 removes a transfer residual toner which has passed through a primary transfer portion T1 and remains on the surface of the photosensitive drum 11.

The intermediary transfer belt 1 is supported by a driving roller 1*a*, a separation roller 1*b* and a supporting roller 1*c* and circulates in the arrow E direction.

A primary transfer roller 15 presses the intermediary transfer belt 1 against the photosensitive drum 11 to form the primary transfer portion T1 between the photosensitive drum 11 and the intermediary transfer belt 1. By applying a DC voltage of an opposite polarity to a charge polarity of the toner image to the primary transfer roller 15 during passing of the toner image on the photosensitive drum 11 through the primary transfer portion T1, the toner image on the photosensitive drum 11 is primary-transferred onto the intermediary transfer belt 1.

A secondary transfer roller 3 presses the intermediary transfer belt 1 against the separation roller 1*b* to form the secondary transfer portion T2 between the intermediary transfer belt 1 and the secondary transfer roller 3. By applying a DC voltage of an opposite polarity to a charge polarity of the toner image to the secondary transfer roller 3 during passing of the toner image on the intermediary transfer belt 1 through the secondary transfer portion T2, the toner image on the intermediary transfer belt 1 is secondary-transferred onto the recording material P.

The recording material P is taken out from a recording material accommodating cassette 6 and separated by a separation device 5 one by one and stands by between registration rollers 4. Then, the recording material P is fed to the secondary transfer portion T2 with timing synchronized with the toner image on the intermediary transfer belt 1.

A cleaning device 18 removes a toner image residual toner which has passed through the secondary transfer portion T2 and remains on the intermediary transfer belt 1.

The secondary transfer roller 3 and the cleaning device 18 are separated from the intermediary transfer belt 1 so as to avoid contact with the toner image until the four color toner images are completely primary-transferred on the intermediary transfer belt 1.

In the image forming apparatus 400, in the case of forming a single color image, the developing device 14 stops in the developing device position for an associated development color and the secondary transfer roller 3 and the cleaning device 18 are left in contact with the intermediary transfer belt 1. Then, similarly as in Second Embodiment shown in FIG. 9, the intermediary transfer belt 1 conveys the single color toner image from the primary transfer portion T1 to the secondary transfer portion T2, at which the single color toner image is immediately secondary-transferred onto the recording material P.

Therefore, in the image forming apparatus 400, in sheet interval control of the single color image, the lower limit of the sheet interval LPS was set to be somewhat larger than a distance from the primary transfer portion T1 to the secondary transfer portion T2.

More specifically, the intermediary transfer belt 1 was constituted by a dielectric resin material and as the intermediary transfer belt 1, a 100 μm-thick film of PVDF (polyvinylidene di-fluoride) resin having a volume resistivity of $10^9$ ohm.cm was employed.

The primary transfer roller 15 was prepared by disposing a 4 mm-thick electroconductive urethane sponge layer on a core metal having a diameter of 8 mm and showed a volume resistivity (resistance) of about $10^5$ ohm.cm.

The process speed was 140 mm/sec.

In the image forming apparatus 400 of this embodiment, in order to downsize an apparatus main assembly, a distance L12 from the primary transfer portion T1 of the photosensitive drum 11 to the secondary transfer portion T2 with respect to a movement direction of the intermediary transfer belt 1 may be 120 mm or less, preferably 90 mm or less. In the image forming apparatus 400, the distance L12 from the primary transfer portion T1 to the secondary transfer portion T2 along a circulating path of the intermediary transfer belt 1 is 60 mm. Therefore, in this embodiment, the lower limit of the sheet interval LSP was 73 mm so as to satisfy the relationship: L12<LPS . . . (1), and the sheet interval control as shown in FIG. 4 was carried out.

Also in Third Embodiment, the frameless printing is performed. For this reason, when the trailing end of the recording material P has passed through the secondary transfer portion T2, a distance Lit from the trailing end of the recording material P to a leading end of an image area on which a toner image to be subsequently subjected to the secondary transfer has been primary-transferred is equal to the sheet interval LPS.

By this, the recording material P is controlled so as not to pass through the secondary transfer portion T2 during the primary transfer at the primary transfer portion T1 of the photosensitive drum 11.

By this, a maximum of the number of output sheets per minute with respect to the A4-size plain paper was 30 sheet/min.

As a result, it was possible to realize the sheet interval control avoiding the image defect similarly as in First Embodiment. A phenomenon that vibration during passing of the recording material P through the secondary transfer portion T2 transmits through the intermediary transfer belt 1 to reach the photosensitive drum 11 during the primary transfer, thus causing a local image deterioration was not observed.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 191503/2007 filed Jul. 24, 2007, which is hereby incorporated by reference.

What is claimed is:

1. An image forming apparatus comprising:

a plurality of image bearing members;

a rotatable intermediary transfer member for carrying toner images transferred from said plurality of image bearing members in contact with said plurality of image bearing members;

a plurality of primary transfer members for press-contacting to said intermediary transfer member, provided correspondingly to said plurality of image bearing members, respectively, for transferring the toner images formed on said plurality of image bearing members onto said intermediary transfer member;

a secondary transfer member for press-contacting to said intermediary transfer member to form a transfer portion, at which the toner images on said intermediary transfer member are to be transferred onto a recording material, wherein the transfer portion is located downstream of a most downstream one of said plurality of image bearing members with respect to a rotation direction of said intermediary transfer member;

a fixing member for fixing toner images transferred onto the recording material by said secondary transfer member; and a control portion for controlling an image forming operation, wherein said apparatus is operable in a continuous image forming mode in which images are formed on a plurality of recording materials conveyed with a preset minimum interval obtained by adjusting an interval between a trailing end of a recording material and a leading end of a subsequent recording material with respect to a recording material conveyance direction so as to be the preset minimum interval, and wherein said control portion controls the image forming operation so that, during execution of the continuous image forming mode, transfer of a toner image to be formed on a subsequent recording material from the second most downstream image bearing member is started and thereafter, the trailing end of a recording material with respect to the recording material conveyance direction passes through the transfer portion and thereafter, transfer of a toner image to be formed on a subsequent recording material from the most downstream image bearing member onto said intermediary transfer member is started.

2. An apparatus according to claim 1, wherein during the execution of the continuous image forming mode, the recording materials are conveyable with an interval more than the preset minimum interval.

3. An apparatus according to claim 1, wherein said plurality of image bearing members is provided under said intermediary transfer member with respect to a vertical direction.

4. An apparatus according to claim 1, wherein said control portion sets the interval between the trailing end of a recording material and the leading end of a subsequent recording material with respect to the recording material conveyance direction depending on a size of the recording materials on which the images are to be formed.

5. An image forming apparatus comprising:

a plurality of image bearing members;

a rotatable intermediary transfer member for carrying toner images transferred from said plurality of image bearing members;

a plurality of primary transfer members for press-contacting to said intermediary transfer member, provided correspondingly to said plurality of image bearing members, respectively, for transferring the toner images formed on said plurality of image bearing members onto said intermediary transfer member at primary transfer portions respectively;

a secondary transfer member for forming a secondary transfer portion at which the toner images on said intermediary transfer member are to be transferred onto a recording material, wherein the secondary transfer portion is located downstream of a most downstream one of primary transfer portions with respect to a rotation direction of said intermediary transfer member;

a fixing member for fixing toner images transferred onto the recording material by said secondary transfer member; and a control portion for executing a continuous image forming mode in which recording materials are continuously conveyed with a preset minimum interval obtained by adjusting an interval between a trailing end of a recording material and a leading end of a subsequent recording material with respect to a recording material conveyance direction so as to be the preset minimum interval and images are formed on the conveyed recording materials, wherein a length of the preset minimum interval is more than a distance between the most downstream primary transfer portion and the secondary transfer portion measured on said intermediary transfer member, and is less than a distance between a second most downstream primary transfer portion and the secondary transfer portion measured on said intermediary transfer member.

6. An apparatus according to claim 5, wherein the secondary transfer portion is a contact portion between said intermediary transfer member and said secondary transfer member.

7. An apparatus according to claim 5, wherein the most downstream primary transfer portion is a contact portion between a most downstream image bearing member and said intermediary transfer member.

8. An apparatus according to claim 5, wherein on said intermediary transfer member, a distance between a central position of the most downstream primary transfer portion and a central position of the secondary transfer portion is less than the length of the preset minimum interval.

9. An apparatus according to claim 5, wherein said plurality of image bearing members is provided under said intermediary transfer member with respect to a vertical direction.

* * * * *